US011006810B2

(12) United States Patent
Gerstner et al.

(10) Patent No.: US 11,006,810 B2
(45) Date of Patent: May 18, 2021

(54) DISHWASHER AND METHOD FOR OPERATING A DISHWASHER

(71) Applicant: BSH Hausgeräte GmbH, Munich (DE)

(72) Inventors: Norbert Gerstner, Herbrechtingen (DE); Karlheinz Rehm, Dischingen (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 16/477,537

(22) PCT Filed: Feb. 9, 2018

(86) PCT No.: PCT/EP2018/053308
§ 371 (c)(1),
(2) Date: Jul. 12, 2019

(87) PCT Pub. No.: WO2018/153698
PCT Pub. Date: Aug. 30, 2018

(65) Prior Publication Data

US 2019/0365194 A1 Dec. 5, 2019

(30) Foreign Application Priority Data

Dec. 23, 2017 (DE) ..... 10 2017 202 936.6

(51) Int. Cl.
*A47L 15/00* (2006.01)
*A47L 15/46* (2006.01)
*A47L 15/42* (2006.01)

(52) U.S. Cl.
CPC ..... *A47L 15/0044* (2013.01); *A47L 15/0002* (2013.01); *A47L 15/46* (2013.01);
(Continued)

(58) Field of Classification Search
CPC ..... A47L 15/0044
See application file for complete search history.

(56) References Cited

U.S. PATENT DOCUMENTS 3,600,602 A 8/1971 Yartz et al.
4,106,517 A 8/1978 Wright
(Continued)

FOREIGN PATENT DOCUMENTS

DE 4233934 A1 4/1994
DE 102006032087 A1 1/2008
(Continued)

OTHER PUBLICATIONS

National Search Report DE 10 2017 202 936.6 dated Oct. 19, 2017.
International Search Report PCT/EP2018/053308 dated Apr. 17, 2018.

*Primary Examiner* — Jason Y Ko
(74) *Attorney, Agent, or Firm* — Michael E. Tschupp; Andre Pallapies; Brandon G. Braun

(57) ABSTRACT

A dishwasher, in particular a domestic dishwasher, includes a control device configured to perform a number of washing programs for washing items to be washed, and an input means configured to register a user input for shortening a running selected washing program. The control device is configured to adjust the running selected washing program as a function of a registered user input in such a manner that a remaining washing time of an adjusted selected washing program is shortened compared with a regular remaining washing time of the running selected washing program.

14 Claims, 6 Drawing Sheets

(52) U.S. Cl.
CPC ..... *A47L 15/4293* (2013.01); *A47L 2501/03* (2013.01); *A47L 2601/02* (2013.01)

(56) References Cited

U.S. PATENT DOCUMENTS

| | | | | |
|---|---|---|---|---|
| 4,318,084 | A | 3/1982 | Scott et al. | |
| 2008/0149144 | A1 | 6/2008 | Siebachmeyer | |
| 2009/0038644 | A1 | 2/2009 | Fauth et al. | |
| 2010/0295690 | A1 | 11/2010 | Berends et al. | |
| 2014/0261552 | A1* | 9/2014 | Ellebracht ..... | A47B 31/001 134/18 |

FOREIGN PATENT DOCUMENTS

| | | | |
|---|---|---|---|
| DE | 102007042076 | A1 | 3/2009 |
| JP | H03215235 | A | 9/1991 |
| JP | H11332814 | A | 12/1999 |
| JP | H11346989 | A | 12/1999 |
| WO | 2008103127 | A1 | 8/2008 |

* cited by examiner

DISHWASHER AND METHOD FOR OPERATING A DISHWASHER

CROSS-REFERENCES TO RELATED APPLICATIONS

This application is the U.S. National Stage of International Application No. PCT/EP2018/053308, filed Feb. 9, 2018, which designated the United States and has been published as International Publication No. WO 2018/153698 A1 and which claims the priority of German Patent Application, Ser. No. 10 2017 202 936.6, filed Feb. 23, 2017, pursuant to 35 U.S.C. 119(a)-(d).

BACKGROUND OF THE INVENTION

The present invention relates to a dishwasher as well as a method for operating a dishwasher.

Known household dishwashers have a plurality of different washing programs, which meet different needs. A washing program typically has the program substeps pre-rinsing, cleaning, intermediate rinsing, final rinsing and drying. The different washing programs are compiled from these components as a function of the soiling of the items to be washed, the type of item to be washed and the time available for a washing cycle, during which process it is also possible to set parameters, such as the quantity of cleaning agent used, the water quantity, the water temperature and/or water pressure, for the individual program substeps.

With a view to operating in the most resource-efficient manner possible, what are known as eco programs have been developed, which consume less water and energy and/or are operated with less cleaning agent than standard programs but still aim to ensure a comparable cleaning result. This is achieved by various measures, which mean overall that the washing operation takes more time, which is generally not a problem, for example if the dishwasher runs overnight.

However there are situations, in which the items being washed are needed quickly. Fast programs for example have been developed for this purpose, bringing about a corresponding cleaning result with increased water and energy consumption.

It may also happen that a user initially decides on a program with a long runtime. However if the user needs items being washed while the program is being performed, said user only has the options of waiting until the washing program ends or interrupting the washing program, in which case the cleaning result is not guaranteed.

The documents DE 10 2005 062 481 A1, WO 2008/103127 A1 and U.S. Pat. No. 4,106,517 show different options for influencing a program sequence for dishwashers.

BRIEF SUMMARY OF THE INVENTION

Against this background it is one object of the present invention to create an improved dishwasher.

According to a first aspect a dishwasher, in particular a household dishwasher, is proposed, with a control device for performing a number of washing programs for washing items to be washed. The dishwasher has an input means for registering a user input for shortening a running selected washing program. The control device is designed to adjust the running selected washing program as a function of the registered user input in such a manner that a remaining washing time of the adjusted selected washing program is shortened compared with a regular remaining washing time of the running selected washing program.

Such a dishwasher has the advantage in particular that a user can speed up the running washing program at any time. In other words, as soon as the user actuates a user input to shorten a running selected washing program by way of the input means, the running selected washing program is adjusted in such a manner that the remaining part of the washing program is performed in a shortened form. The advantage of this is in particular that the washing program is continued from the point the running selected washing program has currently reached. This avoids any repetition of parts of the washing program, which helps save time and resources.

By way of example the selected washing program is an energy-saving washing program with a relatively long runtime of 240 minutes. After 60 minutes the user input for shortening a running selected washing program is performed by way of the input means, which is configured for example as a button. The control device, which performs the running selected washing program, then adjusts the remaining part of the running selected washing program so that the remaining time is only 60 minutes. This saves 120 minutes for example compared with the regular sequence of the running selected washing program.

The control device can be implemented by means of hardware and/or software. In the case of a hardware implementation the control device can be configured as a computer or microprocessor. In the case of a software implementation the control device can be configured as a computer program product, a function, a routine, part of a program code or an executable object. In particular the control device comprises further functions not described here, which ensure operation of the dishwasher.

The control device for example has a storage unit, in which a number of washing programs are stored. The different washing programs are provided for different purposes and have different requirements, for example water quantity, water temperature, dosing times for different dishwashing agent components and the like. For example an energy-saving washing program can be provided, which washes in a particularly energy efficient manner. An intensive washing program can also be provided, which achieves good cleaning results, even for particularly extensive and/or stubborn soiling of the items to be washed. A fast washing program can also be provided, which performs a washing operation particularly quickly. In order to perform a washing operation, the control device for example selects one of the washing programs from the storage unit and stores it in an intermediate storage unit, for example a cache. The washing program stored in the intermediate storage unit is referred to here as the selected washing program. The control device then activates the further structural units of the dishwasher, such as a valve, pump or heating coil for example, as provided for in the washing program. The control device thus processes the requirements of the washing program step by step, until the washing program has been completed and the washing operation is thereby terminated.

The input means for registering the user input is configured for example as a button. The user input is performed by actuating the button. The control device registers the actuation of the button. The control device then adjusts the remainder of the running selected washing program in such a manner that the remaining runtime of the adjusted washing program is shortened compared with the regular remaining runtime. The control device does this for example by overwriting the part of the washing program stored in the intermediate storage unit and not yet processed with the adjusted part of the washing program and then performs the latter. This ensures that the "standard" washing programs stored in the storage unit are not affected by the adjustment.

The input means can be configured in such a manner that a more complex input is possible, for example as a rotary control. This allows the user also to input a time period for example as a function of the rotation angle by actuating the rotary control, in order to shorten the running selected washing program.

The remaining part of the running selected washing program can be adjusted in different ways. In particular it is a function of the type of user input. For example a button can be provided as the input means, which simply transmits a trigger signal to the control device. The trigger signal then initiates for example a predefined adjustment of the washing program, in particular to achieve a minimally short remaining washing time. This can be done by replacing the remaining part of the running selected washing program with the corresponding part of a fast washing program. The fast washing program here represents for example the shortest possible washing program.

With a more complex user input for example a set of relationships can be stored in the control device for adjustment purposes, representing a relationship between desired washing effect and required time. These relationships are for example functions of a respective parameter, for example water temperature, pump speed, water pressure and/or water quantity. Adjustment can then take place by means of an algorithm, for example an optimization algorithm, which adjusts individual or all of said parameters at least for individual parts of the remaining part of the running selected washing program, thereby bringing about a shortened remaining runtime.

According to one embodiment of the dishwasher the control device is designed to adjust the running selected washing program as a function of the user input, while still ensuring a predefined cleaning result.

A predefined cleaning result refers for example to a predefined minimum cleanness and/or a predefined drying state. In particular the predefined cleaning result corresponds to the cleaning result that would be achieved with a regular performance of the selected washing program.

The predefined cleaning result is determined for example in the European Standard EN 50242. The cleaning result is classed for example as grade 1 to 6, a higher number indicating a better cleaning result. A cleaning result better than 4 is deemed to be very good. A cleaning result corresponding to grade 4 is specified as the predefined cleaning result for example.

This embodiment has the advantage in particular that a user can be sure that the cleaning result achieved meets expectations even if the running washing program is shortened.

According to a further embodiment of the dishwasher the remaining washing time of the adjusted selected washing program is shortened by a predefined time period compared with the regular remaining washing time of the running selected washing program.

Provision can be made for example for the user to specify a time period by which the remaining washing time of the running selected washing program is to be shortened by means of an input. The control device is then designed to adjust the running selected washing program in such a manner that the remaining washing time of the adjusted selected washing program is shorted by the predefined time period. This gives the user full control of the remaining washing time of the dishwasher. Adjustment takes place in particular while still maintaining a predefined cleaning result.

According to a further embodiment of the dishwasher the remaining washing time of the adjusted selected washing program is shortened to a maximum compared with the regular remaining washing time of the running selected washing program.

In order to ensure a predefined cleaning result, the remaining washing time cannot be shortened arbitrarily for example. There is then an optimum adjusted washing program, which results in the shortest remaining washing time. In this embodiment the control device adjusts the running selected washing program in such a manner that the adjusted selected washing program corresponds to this optimum washing program.

The optimum washing program can also be a function of the running selected washing program. If for example a very gentle washing program has been selected, because the items to be washed are particularly delicate, provision can be made for the control device to take this into account when adjusting the remaining part of the running selected washing program and for example not to exceed a predefined maximum water temperature.

According to a further embodiment of the dishwasher the washing programs each comprise a sequence of program substeps. The control device is designed to adjust the sequence of the program substeps for the running selected washing program as a function of the user input. Additionally or alternatively the control device is designed to adjust parameters for individual program substeps of the running selected washing program as a function of the registered user input.

For example the control device is designed to leave out individual program substeps and/or only to adjust a parameter, for example the water temperature, in one of the program substeps.

According to a further embodiment of the dishwasher the program substeps comprise pre-rinsing, cleaning, intermediate rinsing, final rinsing and/or drying.

According to a further embodiment of the dishwasher the parameters for the program substeps comprise a water quantity, a water temperature, a pump speed, a water pressure, a fan speed and/or a time period.

According to a further embodiment of the dishwasher the user input comprises a time period, a time and/or a trigger signal.

Depending on the configuration of the dishwasher and control device it is therefore advantageously possible for a user to input a preferred end time for the end of the running washing program as a time. The control device is then designed to adjust the running selected washing program in such a manner that the adjusted selected washing program finishes at the input time.

According to a further embodiment of the dishwasher the input means is configured as a button, a rotary knob, a sliding control, a touch-sensitive surface of a touchscreen and/or a wireless interface.

According to a further embodiment of the dishwasher the input means is configured as a wireless interface and the user input can be registered by way of a mobile interface device.

For example the user of the dishwasher is provided with an app which can be executed on a smartphone. The smartphone establishes a communication connection with the wireless interface of the dishwasher. The user can then actuate a corresponding input in the dishwasher app by means of an input for example on the touch-sensitive screen of his/her smartphone. The input is transmitted to the wireless interface and registered by the control device as the user input for shortening the running selected washing program.

Provision can also be made for the dishwasher to transmit a prospective end time of the running selected washing program and/or of the adjusted selected washing program to the app. The user is then always informed about when the washing operation will be completed.

According to a second aspect a method for operating a dishwasher with a control device for performing a number of washing programs for washing items to be washed is proposed. The dishwasher also has an input means for registering a user input for shortening a running selected washing program. In a first step a run through a washing program selected from a number of washing programs is started. In a second step the user input is registered. In a third step a remaining part of the running selected washing program is adjusted as a function of the registered user input in such a manner that a remaining washing time of the adjusted selected washing program is shortened compared with a regular remaining washing time of the running selected washing program. In a fourth step the adjusted remaining part of the selected washing program is performed.

This method advantageously allows a user to intervene in the ongoing operation of a dishwasher such that the dishwasher completes the running washing program more quickly. This advantageously takes place while still maintaining a predefined washing result, in particular a predefined minimum cleanness and a predefined minimum dryness of the items being washed.

The embodiments and features described for the proposed dishwasher apply correspondingly to the proposed method.

According to a third aspect a computer program product is proposed, which prompts the performance of the method according to the second aspect on a program-controlled device.

A computer program product, for example a computer program means, can be provided or supplied for example as a storage medium, e.g. a memory card, USB stick, CD-ROM, DVD or in the form of downloadable file from a server in a network. This can be achieved in a wireless communication network for example by transferring a corresponding file containing the computer program product or computer program means.

Further possible implementations of the invention comprise combinations of features or embodiments described above or in the following in relation to the exemplary embodiments, even if these are not specifically cited. The person skilled in the art will also add individual aspects to improve or supplement the respective basic form of the invention.

BRIEF DESCRIPTION OF THE DRAWINGS

Further advantageous embodiments and aspects of the invention are set out in the subclaims and in the exemplary embodiments of the invention described in the following. The invention is also described in more detail based on preferred embodiments with reference to the accompanying figures.

DETAILED DESCRIPTION OF EXEMPLARY EMBODIMENTS OF THE PRESENT INVENTION

Figure 1:
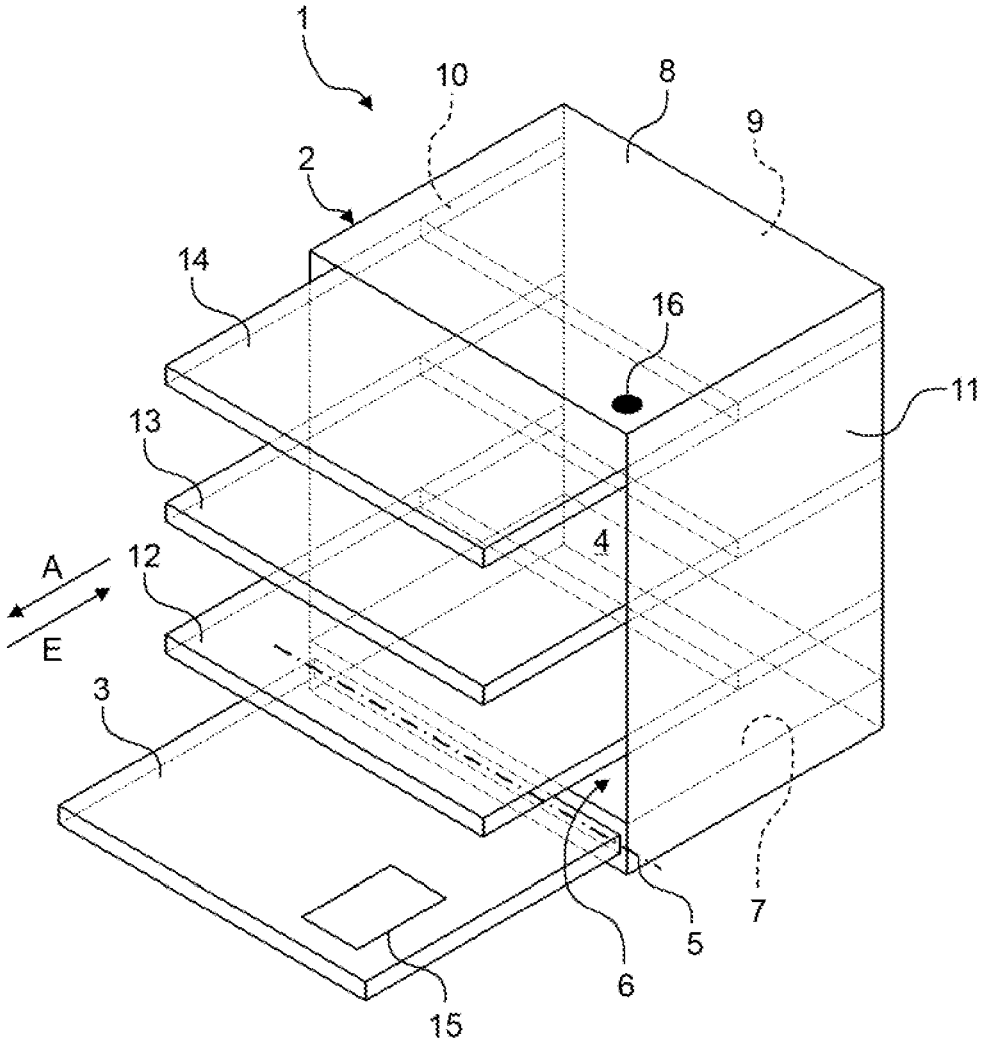
FIG. 1 shows a schematic perspective view of an exemplary embodiment of a dishwasher.

Identical elements or those of identical function are shown with the same reference characters in the figures, unless otherwise specified.

FIG. 1 shows a schematic perspective view of an embodiment of a household dishwasher 1. The household dishwasher 1 comprises a dishwashing container 2, which can be closed, in particular in a water-tight manner, by a door 3. A sealing device can be provided for this purpose between the door and the dishwashing container 2. The dishwashing container 2 is preferably box-shaped for example. The dishwashing container 2 can be arranged in a housing of the household dishwasher 1. The dishwashing container 2 and the door 3 can form a dishwashing chamber 4 for washing items to be washed.

The door 3 is shown in its opened position in FIG. 1. The door 3 can be closed or opened by pivoting about a pivot axis 5 provided at a lower end of the door 3. The door 3 can be used to close or open a loading opening 6 of the dishwashing container 2. The dishwashing container 2 has a base 7, a top 8 arranged opposite the base 7, a rear wall 9 arranged opposite the closed door 3 and two side walls 10, 11 arranged opposite one another. The base 7, top 8, rear wall 9 and side walls 10, 11 can be made of stainless steel for example. Alternative the base 7 for example can be made of a plastic material.

The control device 15 is arranged on the door 3. The control device 15 is designed to control the household dishwasher 1, in particular to perform washing programs P1, P2, P3 (see FIGS. 2, 4). To this end the control device 15 controls different units (not shown here) of the household dishwasher, for example valves, a pump and/or a heating coil, according to the requirements of a selected washing program PA (see FIGS. 3, 4). The household dishwasher 1 also has an input means 16, which is configured here by way of example as a button on the upper face of the household dishwasher 1. The button 16 is designed in particular to register a user input W (see FIG. 4) for shortening the running selected washing program PA.

The household dishwasher 1 also has at least one dish holder 12 to 14. A number of dish holders 12 to 14, for example three, can preferably be provided, it being possible for the dish holder 12 to be a lower dish holder or lower rack, the dish holder 13 to be an upper dish holder or upper rack and the dish holder 14 to be a flatware drawer. As also shown in FIG. 1, the dish holders 12 to 14 are arranged one above the other in the dishwashing container 2. Each dish holder 12 to 14 can be moved as required into or out of the dishwashing container 2. In particular each dish holder 12 to 14 can be pushed into the dishwashing container 2 in an insertion direction E and pulled out of the dishwashing container 2 in a pull-out direction A counter to the insertion direction E.

Figure 2:
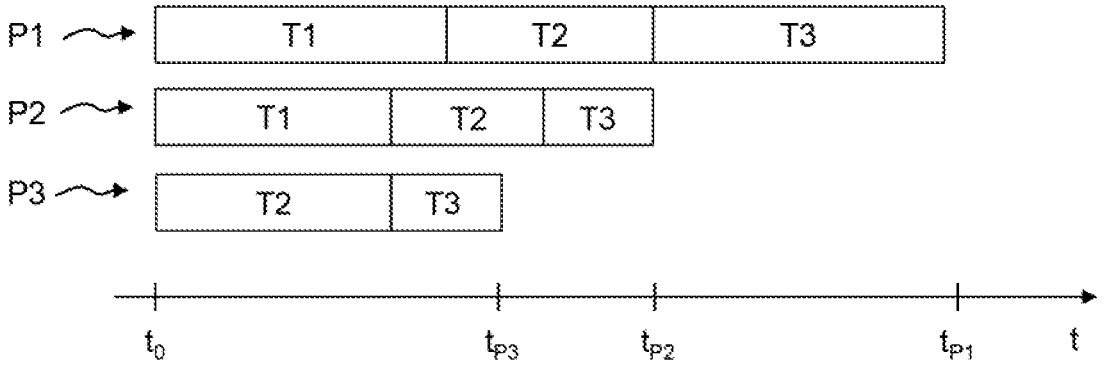
FIG. 2 shows an exemplary flow diagram for a number of washing programs.

FIG. 2 shows an exemplary flow diagram for a number of washing programs P1, P2, P3. The washing programs P1, P2, P3 each have a number of program substeps T1, T2, T3. Each of the washing programs P1, P2, P3 here has a different arrangement of program substeps T1, T2, T3 and/or a different program substep duration. The duration of the washing programs P1, P2, P3 and the individual program substeps T1, T2, T3 is shown on the time axis t. An end time $t_{P1}$, $t_{P2}$, $t_{P3}$, starting from a start time $t_0$, is shown on the time axis t for each of the washing programs P1, P2, P3. For example the washing program P1 is an energy-saving washing program. The duration of the program substeps T1, T2, T3 in particular is of major significance here. The durations of the program substeps T1, T2, T3 of the washing program P1 are therefore longest compared with the further washing programs P2, P3. In the example in FIG. 2 the washing program P3 is the shortest, followed by the washing program P2, followed by the washing program P1.

The program substeps T1, T2, T3 can differ from one another in the different washing programs P1, P2, P3. For example the program substep T1 of the washing program P2 is shorter than the program substep T1 of the washing program P1. The program substeps T1, T2, T3 can also have further different parameters X1, X2, X3 in the different washing programs P1, P2, P3 (see FIG. 5).

Figure 3:
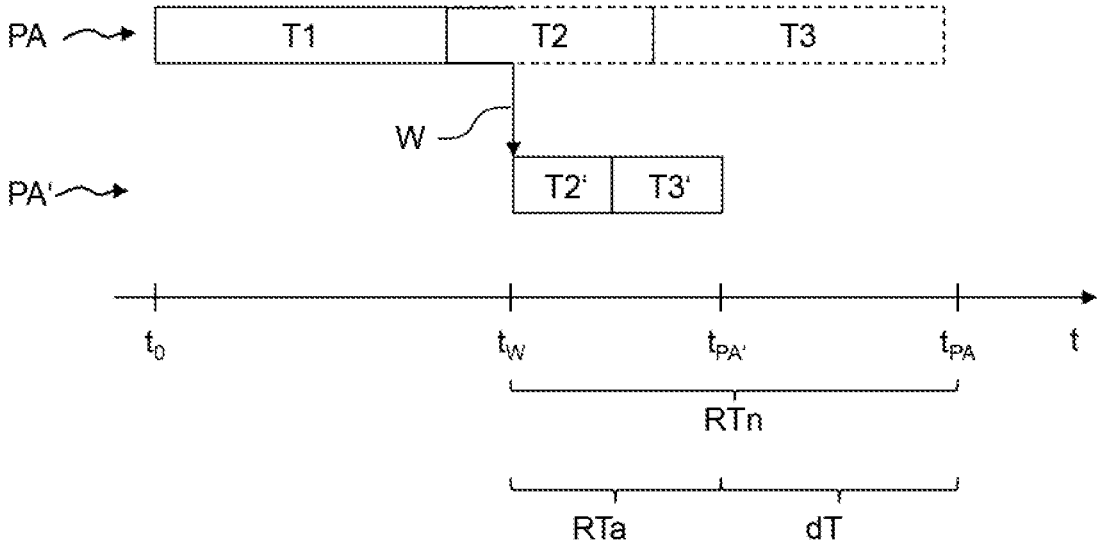
FIG. 3 shows an exemplary flow diagram of a selected and adjusted washing program.

FIG. 3 shows an exemplary flow diagram of a running selected washing program PA and an adjusted selected washing program PA'. For example the initial situation in FIG. 3 is the dishwasher 1 from FIG. 1, wherein the control device 15 can perform the three washing programs P1, P2, P3 shown in FIG. 2. The washing program P1 has been selected. The control device 15 starts the selected washing program PA at time $t_0$. At a time $t_w$, when the running selected washing program PA has already run through around a third of the second program substep T2, the control device 15 registers a user input W. The control device 15 then adjusts the remaining part of the running selected washing program PA (shown with a broken line in FIG. 3) in such a manner that the adjusted selected washing program PA' finishes at an earlier time $t_p$A' than the running selected washing program PA, which would take until time $t_{PA}$. The control device 15 adjusts the parameters for the remaining program substeps T2, T3 in such a manner that the adjusted program substeps T2', T3' have a shorter runtime, while still maintaining the predefined cleaning result. The control device 15 then performs the adjusted selected washing program PA' with the adjusted program substeps T2', T3'. This generally results in a time saving dT, which corresponds to the time difference between the regular remaining runtime RTn of the running selected washing program PA and the remaining runtime RTa of the adjusted selected washing program PA'.

Figure 4:
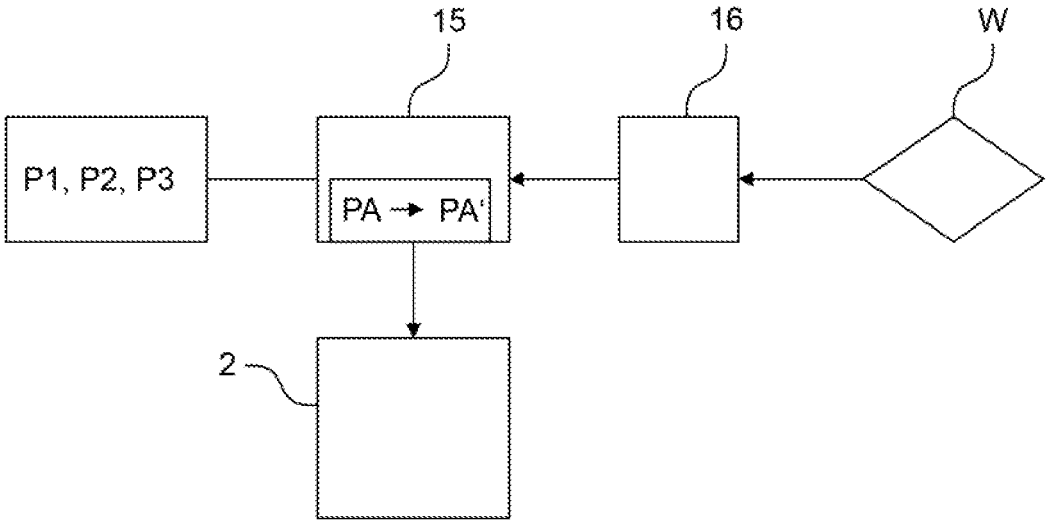
FIG. 4 shows a schematic block diagram of the operation to adjust the selected washing program as a function of a registered user input.

FIG. 4 shows a schematic block diagram of an operation to adjust the selected washing program PA as a function of a registered user input W. First a user input W takes place by means of the input means 16 (see FIG. 1). This user input W is registered by the control device 15 (see FIG. 1). The control device 15 immediately performs a running selected washing program PA, which has been selected from a number of washing programs P1, P2, P3. The registered user input W prompts the control device 15 to adjust the running selected washing program PA in such a manner that the adjusted selected washing program PA' has a shortened runtime. The control device 15 then performs the adjusted selected washing program PA'. This is shown as an action on the dishwashing container 2 (see also FIG. 2) in FIG. 4.

Figure 5:
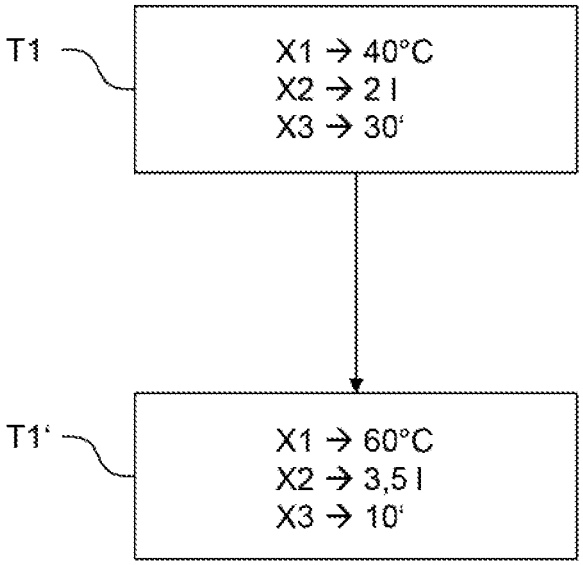
FIG. 5 shows a schematic block diagram of the adjustment of parameters of a program substep.

FIG. 5 shows a schematic block diagram of an adjustment of parameters X1, X2, X3 of a program substep T1, as implemented for example in a washing program P1, P2, P3 according to FIG. 2. In the example the program substep T1 corresponds to pre-rinsing. Regular pre-rinsing T1 should be performed with a water quantity X2 of 2 liters at a temperature X1 of 40° for a period X3 of 30 minutes. The adjusted pre-rinsing T1' in contrast should be performed with a water quantity X2 of 3.5 liters at a temperature X1 of 60° for a period X3 of 10 minutes.

In order to achieve a predefined washing result despite shortening the period X3 from 30 minutes in the regular instance to 10 minutes in the adjusted instance, both the water quantity X2 and the water temperature X1 are increased here. An increased water quantity X2 also allows the pump speed to be increased and a higher water pressure to act on the items being washed, thereby also speeding up the cleaning of the items being washed.

Figure 6:
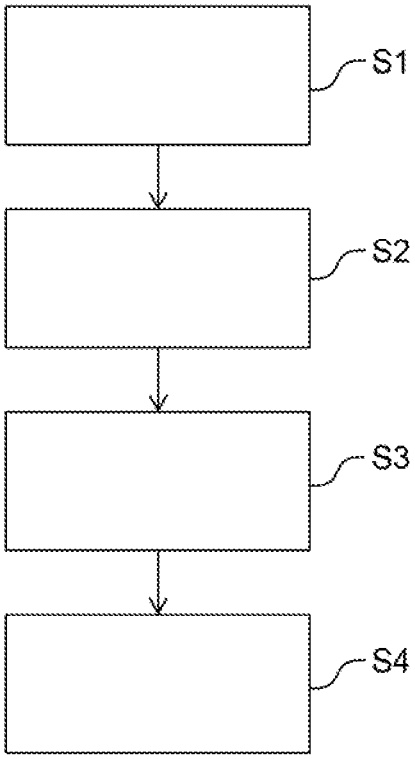
FIG. 6 shows a schematic block diagram of a method for operating a dishwasher.

FIG. 6 shows a schematic block diagram of a method for operating a dishwasher 1, for example the dishwasher 1 in FIG. 1. In a first step S1 a run through a selected washing program PA is started. The control device 15 starts to perform the selected washing program PA (see FIG. 3) according to the instructions stored in the washing program PA. While the selected washing program PA runs, in a second step S2 a user input by way of the input means 16 is registered, the input means 16 being configured for example as a wireless interface, which can communicate with an app that can be executed on a smartphone. In the present instance the user has learned for example that a friend is coming to visit soon. The user instructs the dishwasher 1 via the app on his/her smartphone that the washing operation should end at 14:30 hrs instead of at 16:00 hrs in the regular manner. This is done for example by means of a corresponding voice input, which is interpreted by the app and transmitted to the dishwasher 1 as a user input W. In a third step S3 a remaining part of the running selected washing program PA is then adjusted as a function of the registered user input W. Adjustment takes place in such a manner that a remaining washing time RTa of the adjusted selected washing program PA' is shortened compared with a regular remaining washing time RTn of the running selected washing program PA. Provision can also be made for example for the dishwasher 1 to transmit the prospective end time to the app. In a fourth step S4 the adjusted remaining part of the selected washing program PA' is then performed.

Although the present invention has been described with reference to exemplary embodiments, it can be modified in many different ways.

The invention claimed is:

1. A dishwasher, comprising:

a control device configured to perform a number of washing programs for washing items to be washed; and an input means configured to register a user input for shortening a running selected washing program, wherein the control device is configured to adjust the running selected washing program as a function of a registered user input in such a manner that a remaining washing time of an adjusted selected washing program is shortened compared with a regular remaining washing time of the running selected washing program, and such that the adjusted selected washing program is continued from a point that the running selected washing program has currently reached regardless of whether a rinsing, a cleaning, or a drying is occurring at a time of the registered user input.

2. The dishwasher of claim 1, constructed in the form of a household dishwasher.

3. The dishwasher of claim 1, wherein the control device is configured to adjust the running selected washing program as a function of the user input, while still ensuring a predefined cleaning result.

4. The dishwasher of claim 1, wherein the remaining washing time of the adjusted selected washing program is shortened by a predefined time period compared with the regular remaining washing time of the running selected washing program.

5. The dishwasher of claim 1, wherein the remaining washing time of the adjusted selected washing program is shortened to an optimum time compared with the regular remaining washing time of the running selected washing program.

6. The dishwasher of claim 1, wherein the washing programs have a sequence of program substeps, said control device being configured to adjust the sequence of the program substeps for the running selected washing program as a function of the registered user input and/or to adjust parameters for individual program substeps of the running selected washing program as a function of the registered user input.

7. The dishwasher of claim 6, wherein the program substeps comprise pre-rinsing, cleaning, intermediate rinsing, final rinsing and/or drying.

8. The dishwasher of claim 6, wherein the parameters for the program substeps comprise a water quantity, a water temperature, a pump speed, a water pressure, a fan speed and/or a time period.

9. The dishwasher of claim 1, wherein the user input comprises a time period, a time and/or a trigger signal.

10. The dishwasher of claim 1, wherein the input means comprises a button, a rotary knob, a sliding control, a touch-sensitive surface of a touchscreen and/or a wireless interface.

11. The dishwasher of claim 1, wherein the input means is configured as a wireless interface, said user input being registerable by way of a mobile interface device.

12. A method for operating a dishwasher having a control device for performing a number of washing programs for washing items to be washed and an input means for registering a user input for shortening a running selected washing program, said method comprising:

starting a run through a washing program selected from a number of washing programs;

registering the user input;

adjusting a remaining part of the running selected washing program as a function of the registered user input in such a manner that a remaining washing time of the adjusted selected washing program is shortened compared with a regular remaining washing time of the running selected washing program, and such that the adjusted selected washing program is continued from a point that the running selected washing program has currently reached regardless of whether a rinsing, a cleaning, or a drying is occurring at a time of the registered user input; and performing the adjusted remaining part of the selected washing program.

13. The method of claim 12 for operating a household dishwasher.

14. A computer program product embodied in a non-transitory computer readable medium, wherein the computer program product, when loaded into a program-controlled device and executed by the program-controlled device, causes the program-controlled device to perform the steps of:

starting a run through a washing program selected from a number of washing programs;

registering an user input for shortening a running selected washing program;

adjusting a remaining part of the running selected washing program as a function of the registered user input in such a manner that a remaining washing time of the adjusted selected washing program is shortened compared with a regular remaining washing time of the running selected washing program, and such that the adjusted selected washing program is continued from a point that the running selected washing program has currently reached regardless of whether a rinsing, a cleaning, or a drying is occurring at a time of the registered user input; and performing the adjusted remaining part of the selected washing program.

* * * * *